US006112564A

United States Patent [19]

Rathmann et al.

[11] Patent Number: 6,112,564

[45] Date of Patent: Sep. 5, 2000

[54] LOCK, IN PARTICULAR FOR MOTOR VEHICLE DOORS

[75] Inventors: Klaus Rathmann, Frankfurt; Theo Baukholt, Kriftel; Sven Petzold, Wiesbaden; Jens Lübben, Rastede, all of Germany

[73] Assignee: Mannesmann VDO AG, Frankfurt, Germany

[21] Appl. No.: 09/165,236

[22] Filed: Oct. 1, 1998

Related U.S. Application Data

[63] Continuation of application No. 08/768,652, Dec. 18, 1996.

[30] Foreign Application Priority Data

Dec. 20, 1995 [DE] Germany ..... 195 47 729
May 17, 1996 [DE] Germany ..... 196 19 849

[51] Int. Cl.[7] ..... E05B 47/00

[52] U.S. Cl. ..... 70/279.1; 292/216; 292/201; 292/DIG. 27; 70/264

[58] Field of Search ..... 70/279, 264, 218, 70/DIG. 42; 292/201, 216, DIG. 62, DIG. 27

[56] References Cited

U.S. PATENT DOCUMENTS

| | | | |
|---|---|---|---|
| 1,899,997 | 3/1933 | Sullivan | 70/222 |
| 3,386,761 | 6/1968 | Johnstone et al. | 292/216 |
| 3,587,259 | 6/1971 | Sandor | 70/218 |
| 4,588,217 | 5/1986 | Escaravage | 292/216 |
| 4,617,812 | 10/1986 | Rogers | 70/218 |
| 4,623,178 | 11/1986 | Geringer et al. | 292/DIG. 62 |
| 4,624,491 | 11/1986 | Vincent | 70/279 |
| 4,784,415 | 11/1988 | Malaval | 292/DIG. 62 |
| 4,982,984 | 1/1991 | Yokota eta l. | 292/341.16 |
| 4,998,758 | 3/1991 | Kowalczyk et al. | 292/DIG. 62 |
| 5,100,185 | 3/1992 | Menke et al. | 292/216 |
| 5,138,854 | 8/1992 | Claar et al. | 70/264 |
| 5,309,745 | 5/1994 | Ursel et al. | 70/264 |
| 5,497,641 | 3/1996 | Linde et al. | 70/264 |
| 5,676,003 | 10/1997 | Ursel et al. | 70/218 |
| 5,697,236 | 12/1997 | Kleefeldt et al. | 70/264 |
| 5,702,136 | 12/1997 | Funk et al. | 292/216 |

FOREIGN PATENT DOCUMENTS

| | | | |
|---|---|---|---|
| 0589158 | 3/1994 | European Pat. Off. . | |
| 2631001 | 6/1977 | Germany . | |
| 2911681 | 10/1980 | Germany | 70/264 |
| 3319354 | 12/1983 | Germany . | |
| 4433994 | 3/1994 | Germany . | |
| 2073299 | 10/1981 | United Kingdom . | |
| 2108191 | 5/1983 | United Kingdom . | |
| 2206638 | 1/1989 | United Kingdom . | |
| 2225375 | 5/1990 | United Kingdom | 70/279 |

*Primary Examiner*—Darnell M. Boucher
*Attorney, Agent, or Firm*—Martin A. Faber

[57] ABSTRACT

A lock, particularly for the door of a motor vehicle, having lock elements including at least one lock element which can be connected by connecting elements to at least one manipulator. A coupling device is arranged in a force transmission path between the manipulator and the at least one lock element.

22 Claims, 4 Drawing Sheets

LOCK, IN PARTICULAR FOR MOTOR VEHICLE DOORS

RELATED APPLICATION

This application is a continuation of our co-pending application Ser. No. 08/768,652 filed Dec. 18, 1996, THE ENTIRE CONTENTS OF WHICH IS HEREBY INCORPORATED BY REFERENCE HEREIN.

FIELD AND BACKGROUND OF THE INVENTION

The present invention relates to a lock, particularly a lock for car doors having lock elements in connection with which at least one lock element can be connected by connecting elements to at least one manipulator.

Such a lock is known from European Patent Application 0 589 158 A1, which has a rotary latch which cooperates with a closure bolt or the like and is locked in a locking position by a pawl. A manipulator (door handle) is connected by an electric line to a motorized setting drive which, upon actuation of the handle, acting with a displaceable setting member on the pawl, moves the pawl into its unlocked position when a switch arranged in the electric line is brought into active position by a corresponding switch command of a receiving device or a device connected therewith. The motorized setting drive is an electromagnet having a displaceable iron core as actuator which, however, requires a large structural space since large setting forces are necessary in order to move the pawl out of the locking position into the unlocked position. Furthermore, there is the disadvantage that a high control expense is necessary in order to position the actuator in its two desired positions. Furthermore, a setting drive which is adapted to the forces is expensive.

SUMMARY OF THE INVENTION

It is an object of the invention to provide a lock of improved efficiency, compact construction, and reliable operation.

According to the invention, a coupling device is arranged in a force-transmission path between the manipulator and at least one lock element.

The invention has the advantage that in this way a large number of states (such as, for instance, anti-theft device, a child-proof device, unlocking, locking) can be produced by a rapid coupling (coupling or uncoupling) with, at the same time, the avoidance of structural parts and compliance with possible safety regulations specific to the country.

The invention furthermore has the advantage that a setting device can be used which requires little construction space and is therefore of compact construction. Furthermore, the movement brought about by the setting device (for instance, rotary or linear movement) is used in order functionally to connect the coupling element with a pawl, so that a sufficiently high moment of force for the actuating of the pawl is established. Thereby, the pawl reliably locks a rotary latch in the locking position or moves it into the open position. The coupling device can be arranged between two lock elements, between a lock element and a connecting element, between a connecting element and the manipulator, or between two connecting elements.

It has been found that in the case of a lock which is developed in accordance with the prior art, there is actuation only electrically (by the electromagnet in accordance with EP 0 589 158 A1). A lock which, upon its control operation is actuated only mechanically, i.e. in which the pawl is connected with a manipulator and moved by it, there is little or no difference in the actuating actions for the operator. Therefore, it is provided, in accordance with the invention, that the known actuation of a manipulator, which is connected by connecting elements with the pawl, is developed in such a manner that when the coupling device has been actuated (for instance, the coupling element and the pawl are operatively connected), a sufficiently large moment can be applied by actuation of the manipulator. The large movement insures that the pawl is movable and the rotary latch can be dependably brought from its locking position into its open position. This has the advantage that the mechanical actuation upon the control actuation process has available a sufficiently high moment. On the other hand it is merely necessary to provide that means suitable for the production of the operative connection are used so that, they themselves need not apply a high torque, are of compact construction and thus take up little construction space. Also, in the event that they are operated electrically, only a slight consumption of current is necessary and, in particular, only for a short time. They are inexpensive and, in addition, permit a comfortable actuating of the lock.

For this purpose, the coupling device has a setting device (2) which does not act on lock elements and which, at least in the general case, and possibly also in case of a malfunction, produces or interrupts a connection between manipulator and lock elements (such as pawl). This is particularly important since then the setting devices for the lock elements (such as setting devices acting on the pawl) are eliminated because the control actuation of the lock is effected via the manipulator and the connecting elements which are connected to it, and which act on lock elements.

According to a development of the invention, a rotary latch (1.1) which cooperates with a locking wedge (1.8) or the like and can be locked by a pawl (1.9) in a locking position is provided as lock element. As coupling device, there is associated with the pawl (1.9) at least one coupling element (1.11) which, after the actuating of a manipulator, can be operatively connected with the pawl (1.9).

As a further development of the invention, between the pawl (1.9) and the coupling element (1.11) there is arranged at least one movable coupling member (2.6) which, upon movement of the coupling element (1.11), results in a driving along of the pawl (1.9) or a free travel between the coupling element (1.11) and pawl (1.9). In order to produce the operative connection, this coupling member is provided. When the coupling element is uncoupled, the coupling member makes possible a driving along of the pawl by actuation of the coupling element upon actuation of the manipulator. This does not take place with the coupling member uncoupled, so that the pawl and thus the rotary latch remain in their locked position and the door cannot be opened. In this way an effective anti-theft position is also established.

As a further development of the invention, there is associated with the coupling member (2.6) the setting device (2), which actuates the coupling member (2.6), directly or stepped-down or stepped-up. The movement of the coupling member can be linear or rotary or a combination of the two, while the setting device directly or in stepped-up manner effects the movement of the coupling member. As an alternative to this, it is possible for the movement to take place preferably stepped-down, so that at least frictional forces, rubbings which occur due to dirt and possibly other phenomena (for instance, such as icing) are effectively overcome.

As a further development of the invention, the setting device (2) can be locked in at least two positions. In the case of an electrically operated setting device, such as, for instance, an electromagnet, an electric motor, or the like, this has the advantage that, in the at least two positions which are preferably two end positions, no consumption of electric current takes place which could possibly load the battery of a car and thus discharge it. If the setting device is, for instance, an electric motor which is stepped-down by a gearing, this gearing is advantageously developed in self-locking manner. The switching from a first position into a second position and/or vice versa is effected within a period of time which is less than one second, and preferably within the region of a few milliseconds to 100 milliseconds.

As further development of the invention, the coupling element (1.11) and the pawl (1.9) have stop surfaces (stops 1.26, 1.27). The coupling member (2.6) is movable into a region between the stop surfaces and out of it. These stop surfaces are advantageously developed as stops in order to assure sufficient mechanical strength when these stops lie against the coupling member upon actuation of the manipulator.

As an alternative development of the invention, the coupling element (1.11) and the pawl (1.9) again have stop surfaces (stops 1.26, 1.27), in which connection, between the stop surfaces, there is a coupling which can be actuated by the setting device (2) or electrically. An electrically actuatable coupling is, for instance, developed in the manner that a liquid volume is arranged in suitable form between the stop surfaces, to provide the free travel in current-less condition. Upon the application of a voltage, the electrically actuatable coupling passes into a fixed state and thus effects the operative connection between the pawl and the coupling element. This has the advantage that only low current intensities need be made available to such a coupling in order to produce a dependable operative connection between the pawl and the coupling element. It would also be possible here to use an electromagnet as the electrical actuatable coupling, but this, however, has the disadvantage that, in active state (for instance production of the operating connection), it has a high current consumption. If this high current consumption is unimportant, such a development is also, of course, possible.

As a further development of the invention, the coupling element (1.11) is so connected, via connecting elements (for instance Bowden cable 1.14, 1.15 with core 1.16, 1.17), to the manipulator that upon actuation of the latter, the coupling element is actuated, either directly or with time delay. This has the advantage that, by means of the manipulator and the corresponding connecting elements, the necessary moment can be transmitted to the pawl in order to release the rotary latch on which a high pressure such as door sealing pressure, which can amount to several hundred N (newtons), acts via the locking wedge. Delayed actuation has the advantage that first of all the coupling member can be moved, free of play, into the region between the stop surfaces (stops) before the coupling member is acted on with force by the stop surfaces upon actuation of the manipulator. For this purpose, a free path is provided at a suitable place between the manipulator and the coupling element, an illustrative embodiment of such a free path being shown in the drawings.

As a further development of the invention, in each case two coupling elements (1.11), which can be actuated independently of each other or in common, and setting devices (2) are provided with coupling members (2.6). Each of the coupling elements (1.11) is connected to a manipulator of its own. These components are formed advantageously as identical parts, since this is cost-favorable upon production. Two coupling elements which are actuatable independently of each other or in common have the advantage that, for instance with the coupling elements coupled, the lock and thus the door can be actuated or opened by each manipulator (for instance, door inside handle and door outside handle). In the case of one coupled and one uncoupled coupling member, a child-proof door latch device can be established if the door outside handle can actuate the pawl via the coupled coupling member and the door inside handle cannot actuate the pawl. As a result of this, in the event of the failure of the power supply, the retention of the child-proof device and access from the outside are assured.

As a further development, at least the rotary latch (1.1) has, associated with it, a sensor (rotary-latch switch 1.5) for detecting the position of the rotary latch (1.1) and/or the actuation of the manipulator is detected (for instance also via a switch 1.25, sensor 10.4). Furthermore, a control device (10) for the giving of setting commands has an input device (10.7) (for example a switch for the actuating of a child-proof device), and/or a receiving device (10.8) with which there is associated at least one portable transmitter (10.9) for the giving of setting commands. Such a control device with the associated components is shown in the drawings and described.

As a further feature of the invention, the coupling member (2.6) is connected with a closure cylinder (2.8) or the like. This has the advantage that the coupling member can be brought into its coupled position in the event that the setting device can no longer assume this task, for instance because of a defect or a failure of the current supply. In addition, the intentional coupling or uncoupling of the coupling member by an operator by means of a key is possible. It is also conceivable for the closure cylinder to be connected, in addition or alternatively, with other lock elements which effect an unlocking (such as, for instance, the pawl or the coupling element).

Further according to the invention, an emergency current supply is provided.

The lock of the invention is preferably used in doors, car trunks, gas-tank caps or glove compartments of motor vehicles, but the invention is not limited to this field and other fields of use are possible

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
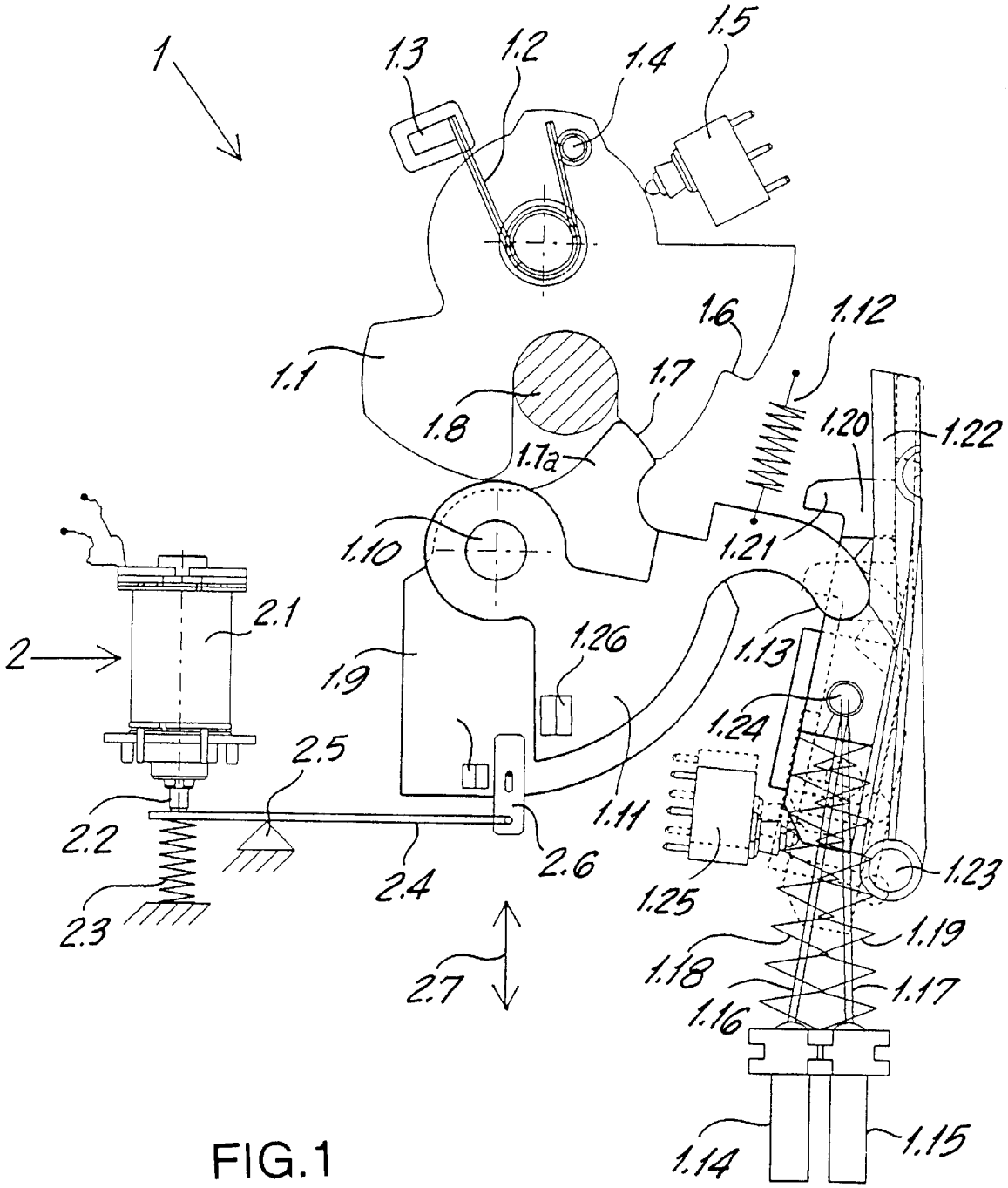
FIG. 1 is a diagrammatic view a lock in its locked position.

A lock 1 shown in FIG. 1 has a rotary latch 1.1 which acts against a rotary-latch spring 1.2, the rotary-latch spring 1.2 being clamped between a stationary stop 1.3 and a stop 1.4 which is arranged on the rotary latch 1.1. The position of the rotary latch 1.1 can be detected by means of a rotary-latch switch 1.5. Furthermore, the rotary latch 1.1 has a shoulder 1.6 with which provides an intermediate detent position (pre-detent). Furthermore, there is a stop surface 1.7 via which the rotary latch 1.1 can be held in its locked position. The rotary latch 1.1 has a U-shape, by its two arms, for surrounding a locking wedge 1.8 and thus, in known manner, holds a car door, for example, in its closed position. A pawl 1.9 which is swingable around a pivot point 1.10 rests via a projection 1.7*a* against the stop surface 1.7 of the rotary latch 1.1. Around the pivot point 1.10, or around another pivot point, there is also mounted a coupling element 1.11 which is held by a spring 1.12 in the position shown in FIG. 1 (possibly resting against a stop, not shown).

Means (such as Bowden cables) are provided to make it possible to turn the coupling element 1.11 from the position shown around the pivot point 1.10 by use of a projection 1.13 on the coupling element 1.11. The means are, for instance, connected with a door inside handle or a door outside handle or other manipulators by which the coupling element 1.11 can be mechanically actuated. In FIG. 1 it is shown that these means are Bowden cables 1.14 and 1.15, having respective cores 1.16 and 1.17, which are prestressed respectively by springs 1.18 and 1.19. The cores 1.16 and 1.17 actuate a lever 1.20 which has a projection 1.21 or an approximately triangular nose resting against the projection 1.13. Upon actuation of the door inner handle or the door outer handle, the projection 1.21 is operatively connected with the projection 1.13 so that the coupling element 1.11 is turned and, under certain circumstances which will be explained further below, brings the pawl 1.9 out of its locked position (as shown in FIG. 1) into an open position so that the rotary latch 1.10 releases the locking wedge 1.8.

The lever 1.20 is, for instance, displaceable linearly on an apparatus part 1.22, in which connection this apparatus part 1.22 may be, but need not be, swingable around a pivot point 1.23. The cores 1.16 and 1.17 are fastened at an attachment point 1.24 to the lever 1.20. This attachment point 1.24 can be so developed that the actuation of the door inside handle is independent of a movement of the door outside handle, and vice versa. The actuation can be detected by means of a switch 1.25.

In accordance with the invention, a setting device 2 is now provided which may, for instance, be an electromagnet 2.1 having a linearly displaceable actuator 2.2 which, upon energization of the electromagnet 2.1, acts against a spring 2.3. The displacement of the actuator 2.2 acts on a lever 2.4 which pivots about a pivot point 2.5. Instead of the linear movement, a setting device with a movement of rotation or a combination of the two can also be provided. The pivoting of the lever around the pivot point 2.5 results in a substantially linear displacement of a coupling member 2.6 in a direction of movement 2.7. It is also conceivable for the setting device to act, directly or else stepped-down or stepped-up by gearing (not shown), on the coupling member 2.6, in which case then once again linear or rotary movements are conceivable. In FIG. 1 it is shown that the coupling member 2.6 has substantially an elongated rectangular shape, in which connection also other embodiments adapted to the constructions (such as, for instance, a wedge-shaped development) are also conceivable. Furthermore, it is conceivable that the coupling member 2.6 and/or the components actuating the coupling member 2.6 (for instance setting device 2, lever 2.4) are arranged on the pawl 1.9 or the coupling element 1.11.

The coupling element 1.11 has a stop 1.26, and the pawl 1.9 has a stop 1.27 which are arranged offset with respect to each other. Thereby, the coupling member 2.6 is located between the two stops 1.26 and 1.27 prior to actuation of the setting device 2, and upon actuation of the setting device 2, is displaced away from this region of the stops. If desired, operation of the setting device 2 and the spring 2.3 can be reversed to place the coupling member 2.6 between the stops 1.26 and 1.27 upon actuation of the setting device 2, with the spring 2.3 urging the coupling member 2.6 away from the region of the stops 1.26 and 1.27 upon deactuation of the setting device 2.

If the coupling member 2.6 is in the coupled position (FIG. 1 shows the uncoupled position), then, upon actuation of the door inside handle or door outside handle, the stop 1.26 is pressed by the turning of the coupling element 1.11 against the coupling member 2.6 and the latter is pressed against the stop 1.27 of the pawl 1.9 so that, in this way, the pawl 1.9 is moved out of its locking position into its open position and thus releases the rotary latch 1.1. If the coupling member 2.6 is moved by suitable control of the setting device 2 out of the region of the stops (in particular, out of the region of the stop 1.26), the coupling element 1.11, upon actuation of the door inside handle or door outside handle, can be swung around the pivot point 1.10, but the pawl 1.9 cannot be carried along with it. Thereby, the rotary latch 1.1 and thus closure wedge 1.8 cannot be released, whereby an anti-theft position and furthermore a child-proof door latch as well as the prevention of unauthorized opening from the outside, are obtained.

With respect to the position of the coupling member 2.6 and the anti-theft position or in an unlocked position, there are several possibilities. One is that the coupling member 2.6 is located fundamentally (for instance, with the setting device 2 unactuated and the spring 2.3 developed as a compression spring) outside of the region of the stops 1.26 and 1.27 (anti-theft position). Upon actuation of the manipulator after an opening request by the vehicle operator who is, for instance identified by a transmitter 10.9 (FIG. 2) and has given a corresponding transmission command, the switch 1.25 is then switched in active position. The switch 1.25 actuates the setting device 2, and the coupling member 2.6 moves into the region of the stops 1.26 and 1.27 before the projection 1.21 of the lever 1.20 conveys the projection 1.13 of the coupling element 1.11 and releases the rotary latch 1.1. In addition, it is possible to leave the coupling member 2.6 in unactuated condition of the setting device 2 within the region between the stops 1.26 and 1.27 and to move it out of this region (by actuation of the setting device 2) only in the event that the anti-theft safety or a child-proof device are connected.

Figure 2:
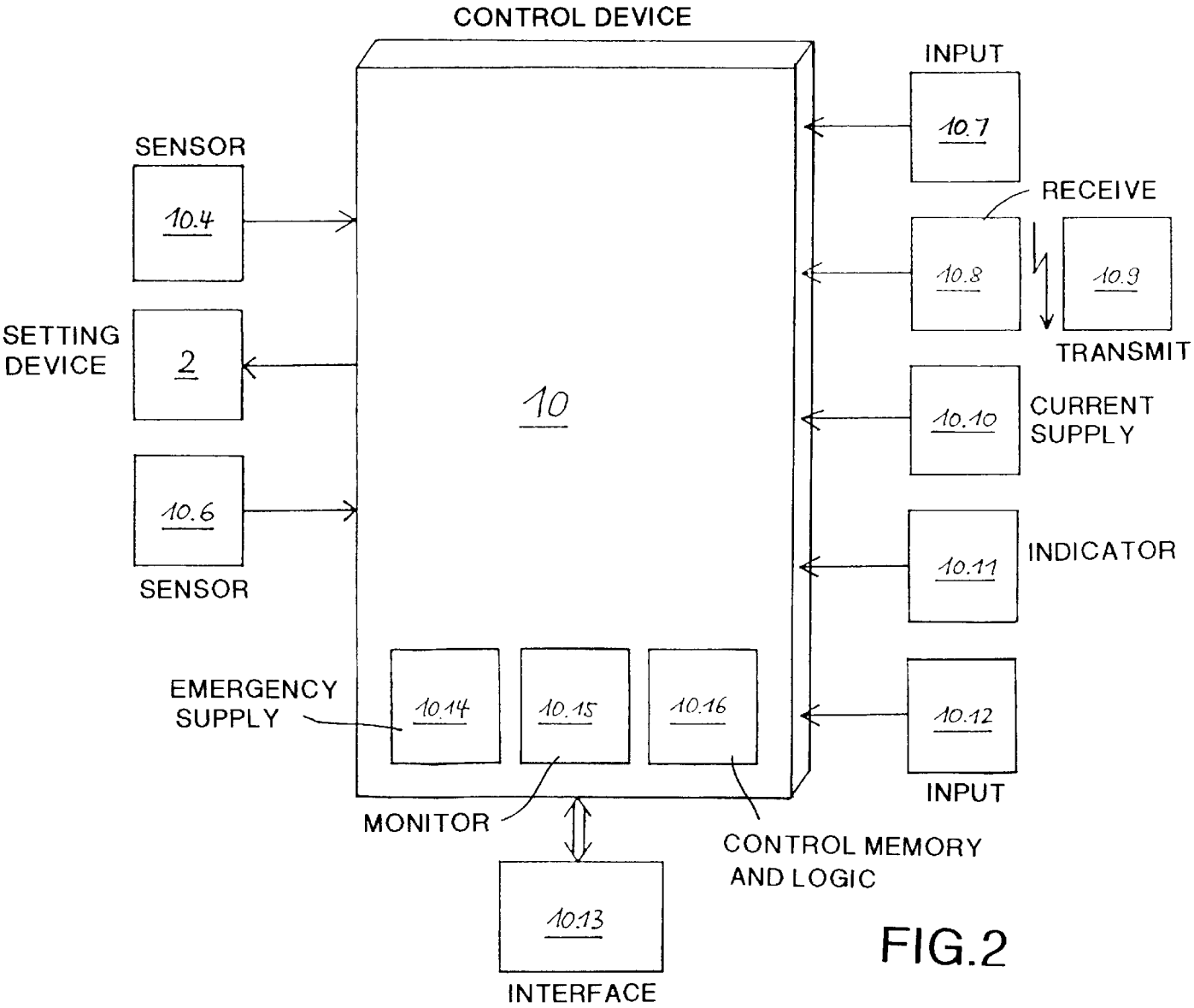
FIG. 2 is a block circuit diagram of a control device.

The conditions under which the setting device 2, particularly with due consideration of the signal of the lever switch 1.25 or the like which readily detect the actuation of a manipulator, the movements of the connecting elements or the like, are actuated as is described further in an example of a control device of FIG. 2.

FIG. 2 shows a control device 10 by which the setting device is controlled as a function of opening and closing commands. For this purpose, the control device 10 is connected with the setting device 2 (in particular, the electromagnet 2.1), the control device 10 receiving via sensors 10.4 (switches or the like) information with regard to the actuation of at least one manipulator (door handle, push button, or the like) and/or, via a sensor 10.6 (rotary latch switch 1.5), information as to the position of the rotary latch 1.1. Furthermore, the control device 10 has associated with it an input device 10.7 (for instance a switch for the activating or deactivating of a child-proof device) and a receiving device 10.8. Opening or closing commands are transmissible via a transmitter 10.9 to the receiving device 10.8. Furthermore, there are associated with the control device 10 a current supply 10.10, an indicating device 10.11 (for the status indication), and a further input device 10.12 (for special functions, which will be explained further below).

In addition, the control device 10 can be provided with an interface 10.13 over which given functions can be established via which further information with regard to the status of the vehicle can be transmitted to the control device 10. An emergency current supply 10.14 and a voltage monitor 10.15 which, for instance, activates the emergency current supply 10.14 when a predetermined voltage threshold exceeds the monitored voltage, are integrated in the control device 10. The two components 10.14 and 10.15 can be present, but need not be. By the reference numeral 10.16 there is indicated an input and output control as well as a control and memory logic by which, for instance, stored in a program, the functions of the control device 10 are carried out.

The control device 10 operates as follows:

First of all, let us assume that the electromagnet 2.1 is without current and the coupling member 2.6 has been moved out of the region of the stops 1.26/1.27 by the electromagnet 2.1 or by the development of the spring 2.3 as compression spring, so that while the door inner handle or door outer handle can be actuated, the pawl 1.9 is not turned. This means that the car doors are closed and thus an anti-theft device is connected. If the driver of the vehicle for instance desires the opening of at least one door or the actuation of the entire central locking system, he actuates the transmitter 10.9 or, for instance, also the other input device 10.12, it being so developed that it can be actuated only under certain conditions with which the driver is, for instance, acquainted. This can, for instance, be the entering of a numerical code. After this entering or actuation of the transmitter 10.9, the switch or switches 1.25 are switched into active position so that then, after actuation of the door inside handle or door outside handle, the setting device 2 is actuated, i.e. the electric motor 2.1 is connected until the coupling member 2.6 is moved into the region of the stops 1.26/1.27.

In this regard, the arrangement of the switch 1.25 and the connecting of the setting device 2 are to be so selected that a pulling on one of the cores 1.16/11.7 first of all actuates the switch 1.25 which triggers the connecting of the coupling member 2.6 and only then, when the coupling member 2.6 is coupled, does the further pulling on one of the cores 1.16/1.17 effect the turning of the coupling element 1.11 and the driving of the pawl 1.9 so that the rotary latch is released from its locked position into its open position. For this purpose, the lever 1.20 has a certain lead with respect to the projection 1.13 so that upon the pulling of one of the cores 1.16/1.17, the switch 1.25, and only then after a sufficient time in order to couple the coupling member 2.6 as far as possible free of play, enables actuation of the coupling element 1.11. When the rotary latch 1.1 has reached its open position, this is recognized by the sensor 10.6 (rotary latch switch 1.5) and the setting device 2 remains in its position. After the release of the door inside handle or door outside handle, the locking pawl 1.9 comes under spring load against the rotary latch 1.1 so that, when the door is closed, the closure wedge 1.8 is forced into the rotary latch 1.1, and the spring-loaded pawl 1.9 holds the rotary latch 1.1 after a "snapping" in its locking position.

It is also conceivable that the coupling member 2.6 is located between stops 1.26/1.27 (by development of the spring 2.3 as tension spring or corresponding control of the electromagnet 2.1) and then, when an anti-theft position is desired, upon actuation of the door outside handle (possibly also the door inside handle) and thus of the switch 1.25, the setting device 2 is controlled in due time in order to move the coupling member 2.6 out of the region between the stops 1.26/1.27. If the door is to be opened, the setting device 2 is not controlled so that the mechanical operative connection between the door inside handle or door outside handle up to the pawl 1.9 (as already described) can be produced. In the event that the coupling member 2.6 is uncoupled and is to be coupled (or vice versa), and the regular supply of current (for instance a car battery) has failed (for instance due to a defect, accident, or broken cable), an emergency current supply can be provided in particular in the control device.

Figure 3:
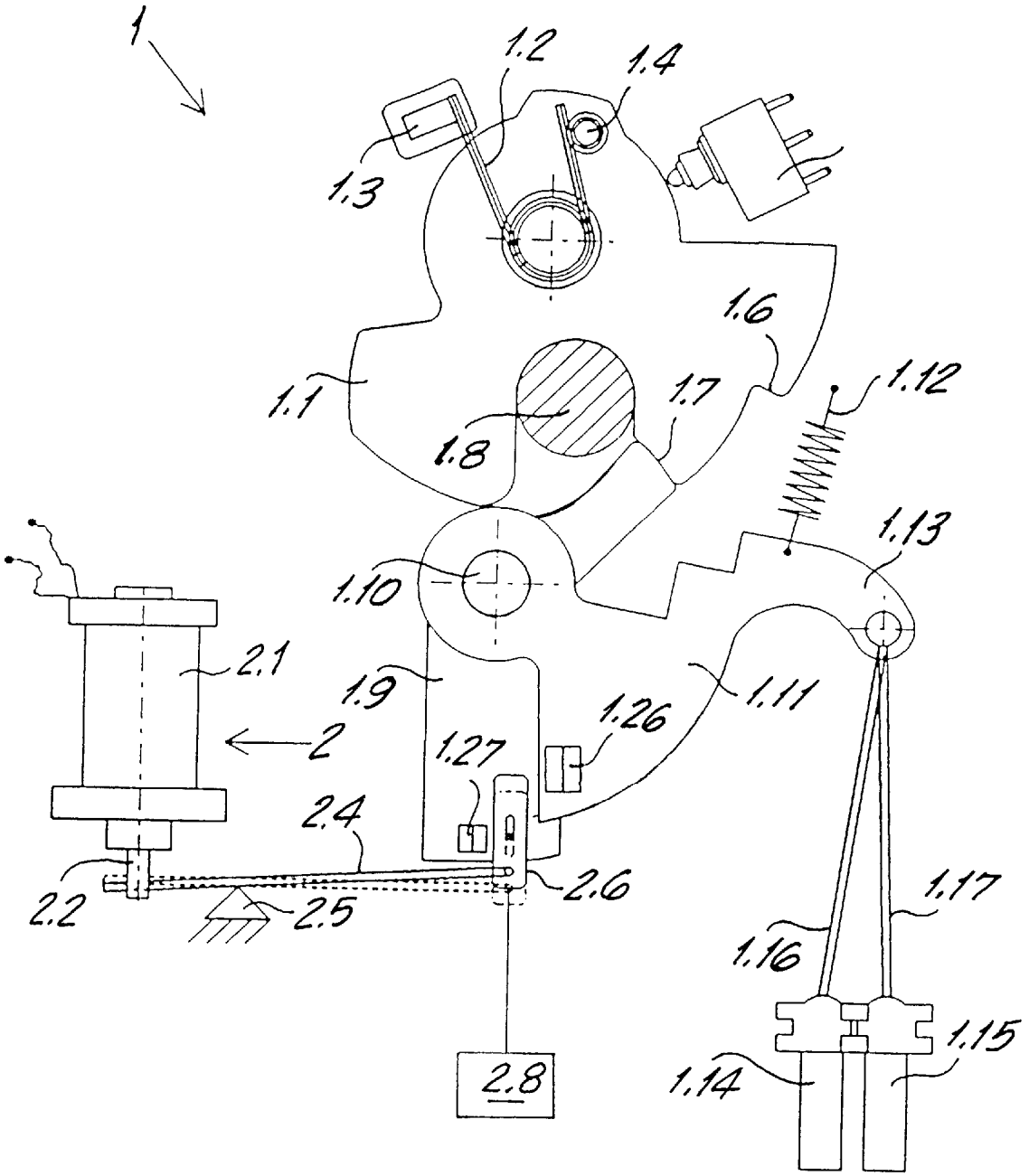
FIG. 3 shows diagrammatically another embodiment of the lock.

FIG. 3 shows another embodiment of the lock 1 wherein the setting device 2 can be locked in at least two positions (bistable development), which constitutes a particularly preferred case of use. As a modification of the embodiment shown in FIG. 1, it is shown in FIG. 3 that the cores 1.16, 1.17 of the Bowden cables 1.14, 1.15 act directly on the projection 1.13 or on some other region of the coupling element 1.11. In addition, it is shown that the coupling member 2.6 is connected to a closure cylinder 2.8 (indicated diagrammatically) via connecting elements (such as Bowden cables, levers, rods, or the like).

The preferred manner of operation is as follows, it not being limited to the construction shown in the figures.

The coupling member 26 is coupled in a basic position so that it is within the region of the stops 1.26/1.27. This applies to the "unlocked" "locked" and "child-proof" positions. When the door outside handle is pulled in the locked condition or the door inside handle is pulled in the "child-proof" position, the setting device 2 is actuated by the control device 10 so that the coupling member 2.6 is moved at least out of the region of the stop 1.26 before the pawl 1.9 can be actuated. The actuation of the manipulator is detected by suitable sensors (for instance microswitches) in the manipulator. If the vehicle is turned off and the lock 1 is in the theft-proof state, the coupling member 2.6 is permanently disconnected. For this purpose the setting device 2 can be locked in at least two positions in which no supply of current is necessary, so that a continuous flow of current can be dispensed with in these positions. This manner of procedure which has been described has the advantage that, in the event of a failure of the current supply, the coupling member 2.6 is always within the region of the stops 1.26/1.27 so that, in the event of a malfunction (for instance, an accident), there is always the possibility of opening the door or the like by at least one manipulator (in particular, door outside handle).

Another advantage is that an emergency energy supply can also be dispensed with. In order that, upon failure of the current supply in the theft-proof condition, the door or the vehicle can be opened, the closure cylinder 2.8 is advantageously provided, which can for example couple the coupling member 2.6, if it was uncoupled. This is done preferably on a single door of the vehicle. In addition or as an alternative to the closure cylinder 2.8, a so-called charge-support point can also be provided via which, from the outside of the vehicle, current can be fed at least to the control device 10 and the locked components connected to it.

This manner of operation is again indicated below in tabular form:

Starting Position

Coupling member 2.6 coupled in locked position:

Upon actuation the door outside handle the at least one switch (10.4) is actuated, the actuator (2) is connected, and the coupling member (2.6) is uncoupled so that the force transmission path between pawl (1.9) and door outside handle is interrupted so that access from the outside is not possible. Upon the actuating of the door inside handle, the door can be opened.

Coupling member 2.6 coupled in unlocked position:

Upon the actuating of the door outside handle or of the door inside handle the switch (10.4) is actuated, but the actuator (2) is not connected, so that the coupling member (2.6) remains coupled, the force transmission path is not interrupted, and the door can be opened from the outside or the inside.

Coupling member 2.6 coupled in child-proof position:

Upon actuation of the door inside handle, the switch (10.4) is actuated, the actuator (2) is connected and the coupling member (2.6) is uncoupled so that the force transmission path between pawl (1.9) and door inside handle is interrupted, so that opening of the rear door is not possible. Upon actuation of the door outside handle, the door can be opened.

Coupling member 2.6 coupled in anti-theft position:

Upon the locking of the vehicle (key/remote control), the coupling member (2.6) is uncoupled so that the force transmission path between manipulator and pawl (1.9) is interrupted and access to the vehicle is not possible.

Figure 4:
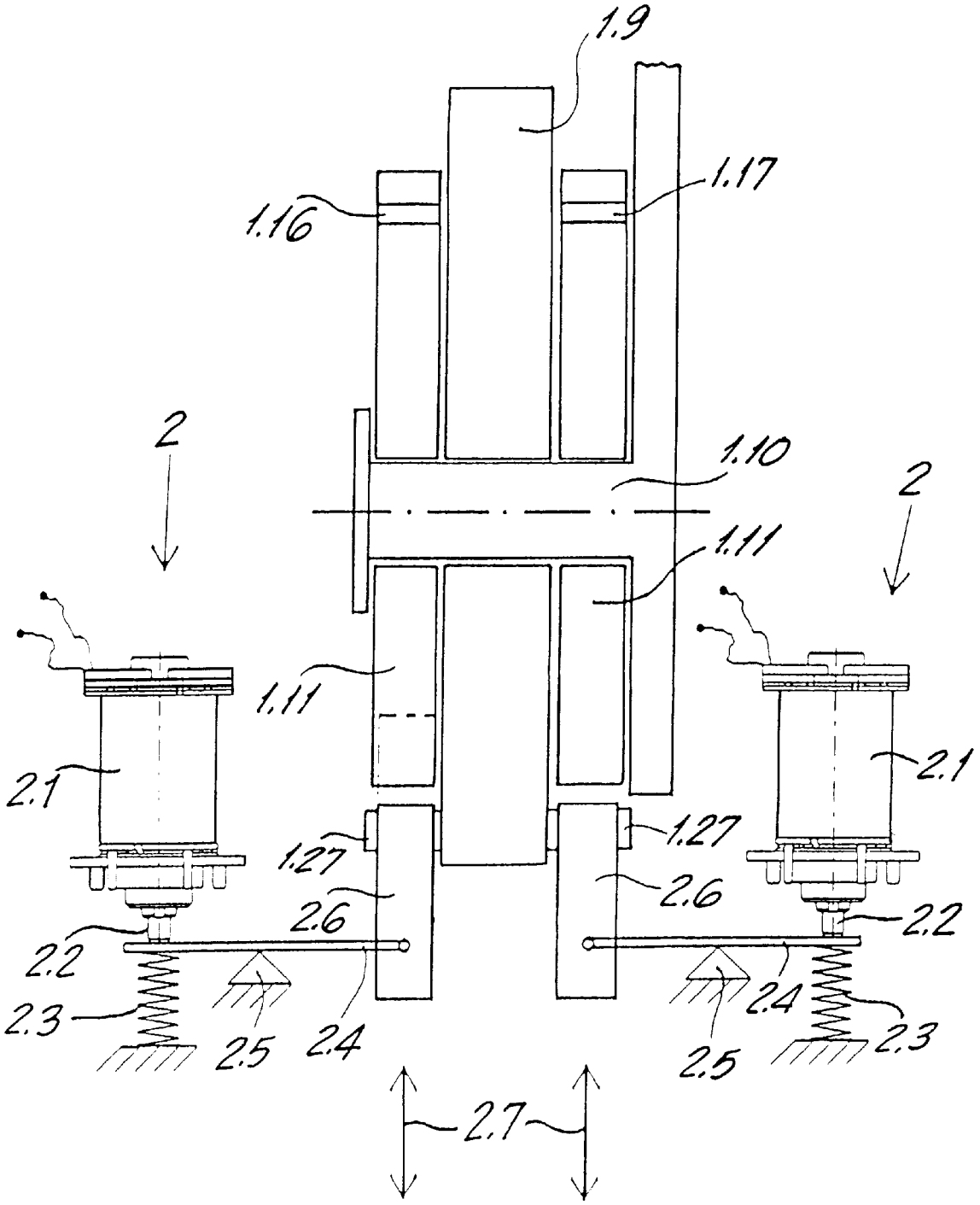
FIG. 4 is a view of the lock showing coupling elements.

It is also possible in each case to have two coupling elements 1.11 and two coupling members 2.6 such as shown in FIG. 4. One of the coupling elements 1.11 can act, in each case, via one of the coupling members 2.6 on the pawl 1.9. For his purpose, a separate setting device 2 is associated with a respective one of the coupling members 2.6. With the foregoing configuration of the lock, the actuating of the door outside handle is detected and the corresponding setting device is actuated. Also, independently of, or jointly with, the actuating of the outside door handle, the actuating of the door inside handle is detected and as a function thereof, the other setting device is controlled. Thus it is possible to have actuating of the door outside handle, independently of an actuation of the door inside handle (or the reverse), or with simultaneous actuation of door inside handle and door outside handle, to act on the pawl in order to open the door. This actuation is available in so far as this may be desired by the operator of the vehicle and/or is permitted as a unction of other parameters (as for example, a child-proof door-catch).

We claim:

1. A lock, suitable for a car door, the lock comprising:

lock elements of which at least one lock element is connectable by connecting elements to at least one manipulator of the lock;

a latch, and a pawl for locking the latch in a locking position to serve as one of said lock elements;

a coupling device arranged in a force-transmission path between the manipulator and at least one of said lock elements, the coupling device including a setting device; and wherein said coupling device comprises a coupling element and coupling member through which force of said force transmission path is transmitted, said coupling member being movable out of said path to prevent transmission of said force for decoupling said manipulator from said at least one of said lock elements; and the coupling element and the pawl have, respectively, a first stop and a second stop, there being a coupling between said first stop and said second stop which is actuatable by said setting device.

2. A lock according to claim 1, wherein said setting device is decoupled from engagement with said one lock element, said setting member serving to displace said coupling member.

3. A lock according to claim 1, further comprising a locking wedge; and wherein the rotary latch engages with the locking wedge in the locking position; and said at least one coupling element, via said coupling member, operatively interconnects said manipulator with said pawl upon actuation of said manipulator.

4. A lock according to claim 3, wherein said coupling member regulates a connection between said coupling element and said pawl to enable either a driving of said pawl by said coupling element or a free travel between said coupling element and said pawl.

5. A lock according to claim 4, wherein said setting device actuates said coupling member to provide for said driving of the pawl for said free travel.

6. A lock according to claim 5, wherein actuation of said coupling member by said setting device is accomplished either directly or via a stepped up or stepped down mode of actuation.

7. A lock according to claim 5, wherein said setting device is lockable in at least two positions.

8. A lock according to claim 4, wherein said coupling member is movable into and out of a region between said first and said second stops.

9. A lock comprising:

lock elements of which at least one lock element is connectable by connecting elements to at least one manipulator of the lock;

a coupling device arranged in a force-transmission path between the manipulator and at least one of said lock elements;

a rotary latch, a locking wedge, and a pawl; and wherein said coupling device comprises a coupling element and coupling member through which force of said force transmission path is transmitted, said coupling member being movable out of said path to prevent transmission of said force for decoupling said manipulator from said at least one of said lock elements;

the rotary latch engages with the locking wedge and is lockable by the pawl in a locking position;

said at least one coupling element, via said coupling member, operatively interconnects said manipulator with said pawl upon actuation of said manipulator;

said coupling device further comprises a setting device; and wherein the coupling element and the pawl have, respectively, a first stop and a second stop, there being a coupling between said first stop and said second stop which can be actuated by said setting device.

10. A lock comprising:

lock elements of which at least one lock element is connectable by connecting elements to at least one manipulator of the lock;

a coupling device arranged in a force-transmission path between the manipulator and at least one of said lock elements;

a rotary latch, a locking wedge, and a pawl; and wherein said coupling device comprises a coupling element and coupling member through which force of said force transmission path is transmitted, said coupling member being movable out of said path to prevent transmission of said force for decoupling said manipulator from said at least one of said lock elements;

the rotary latch engages with the locking wedge and is lockable by the pawl in a locking position;

said at least one coupling element, via said coupling member, operatively interconnects said manipulator with said pawl upon actuation of said manipulator;

said coupling device further comprises a setting device; and wherein the coupling element and the pawl have, respectively, a first stop and a second stop, there being a coupling between said first stop and said second stop which can be actuated electrically.

11. A lock according to claim 3, wherein said coupling element introduces a time delay.

12. A lock according to claim 3, wherein said coupling element comprises a Bowden cable with core connecting with said manipulator for actuation by the manipulator.

13. A lock according to claim 5, further comprising a second coupling element and a second manipulator and a second coupling member and a second setting device in said lock, said two coupling members being actuatable independently of each other or in common; and said setting devices are operative with respective ones of said coupling members, said two coupling elements being connected to respective ones of said manipulators.

14. A lock according to claim 3, further comprising a sensor for detecting a position of said rotary latch.

15. A lock according to claim 14, wherein said sensor of latch position is a switch abutting a surface of said rotary latch.

16. A lock according to claim 1, further comprising a sensor for detecting a position of said manipulator.

17. A lock according to claim 16, wherein said sensor of manipulator position is a switch abutting a surface of said manipulator.

18. A lock according to claim 1, further comprising a control device having an input device and a receiving device, said control device serving to provide setting commands for operation of said coupling device.

19. A lock according to claim 18, wherein said input device is a switch.

20. A lock according to claim 18, wherein said receiving device comprises a portable transmitter.

21. A lock according to claim 4, further comprising a closure cylinder for operating said coupling member.

22. A lock according to claim 5, further comprising an emergency current supply for energizing said setting device.

* * * * *